US008857119B2

(12) United States Patent
Nakashima et al.

(10) Patent No.: US 8,857,119 B2
(45) Date of Patent: Oct. 14, 2014

(54) WOODEN MEMBER ASSEMBLY

(71) Applicant: Sumitomo Forestry Co., Ltd., Tokyo (JP)

(72) Inventors: Hiroki Nakashima, Tokyo (JP); Junichi Imai, Tokyo (JP); Hiroki Ishiyama, Tokyo (JP)

(73) Assignee: Sumitomo Forestry Co., Ltd., Tokyo (JP)

( * ) Notice: Subject to any disclaimer, the term of this patent is extended or adjusted under 35 U.S.C. 154(b) by 0 days.

(21) Appl. No.: 13/793,525

(22) Filed: Mar. 11, 2013

(65) Prior Publication Data

US 2014/0090317 A1 Apr. 3, 2014

(30) Foreign Application Priority Data

Mar. 12, 2012 (JP) ..... 2012-055113

(51) Int. Cl.
*E04C 5/08* (2006.01)
*E04C 3/18* (2006.01)

(52) U.S. Cl.
CPC ..... *E04C 3/18* (2013.01)
USPC ..... 52/223.8; 52/223.9; 52/223.11; 52/223.4; 52/364; 52/365

(58) Field of Classification Search
CPC ..... E04B 1/26; E04B 1/2604
USPC ..... 52/223.8, 364–365
See application file for complete search history.

(56) References Cited

U.S. PATENT DOCUMENTS

| | | | | |
|---|---|---|---|---|
| 3,129,472 | A * | 4/1964 | Hensel | 403/7 |
| 4,067,656 | A * | 1/1978 | Dennis | 403/296 |
| 4,144,687 | A * | 3/1979 | Brunes | 52/223.9 |
| 4,442,149 | A * | 4/1984 | Bennett | 428/53 |
| 2004/0065030 | A1 * | 4/2004 | Zambelli et al. | 52/223.13 |
| 2012/0317905 | A1 * | 12/2012 | MacDuff | 52/220.2 |

FOREIGN PATENT DOCUMENTS

| | | | |
|---|---|---|---|
| JP | 2007-77611 | * | 3/2007 |
| JP | 3152531 U | | 8/2009 |

* cited by examiner

*Primary Examiner* — Mark Wendell
(74) *Attorney, Agent, or Firm* — The Webb Law Firm

(57) ABSTRACT

Wooden member to be easily joined to another member, with good appearance of decreased size fixation structure for tensile member to improve the load bearing performance. Metal screw members including cylindrical shaft portions having an axial direction through hole and blade spirally protruding from the shaft portion are axially threaded into wooden member at two locations. Groove or hollow hole is between the two screw members, and steel rod extends from the through hole of one of the screw members through the groove or hollow hole into the through hole of the other. Both ends of the steel rod with tensioning force are locked to the screw member by nuts. Cutout recesses are formed in the wooden member, and the screw members are threaded into the wooden member through the recesses and the steel rod is locked to the screw members.

16 Claims, 11 Drawing Sheets

A-A VIEW

B-B CROSS SECTION

C-C CROSS SECTION
101
1
2
3
4
5
6
7
8
A
B
C

D-D VIEW

E-E CROSS SECTION

F-F CROSS SECTION
11
111
12
13
14
16
D
E
F

G-G VIEW

H-H CROSS SECTION
21
22
23
24
26
27
29
121
G
H

WOODEN MEMBER ASSEMBLY

BACKGROUND OF THE INVENTION

1. Technical Field

The present invention relates to a wooden member assembly made of a wooden material, such a laminated wood formed by bonding small cross-section wood pieces or a natural wood piece, and a tensile member installed in an axial direction thereof, wherein prestress has been introduced into the wooden member by the tensioning force of the tensile member.

2. Related Art

A wooden building may be required to have a structure provided with a large space, such as a room in which many people can join or a parking space where a plurality of cars can be parked. To provide such a large space, cross members, such as beams, must be spanned between columns provided at large intervals to support the load from the roof or the upper floors.

A wooden material reinforced using a steel member or the like is sometimes used as a cross member which is spanned across a large distance to support the load from the upper floors or roof. For example, Patent Literature 1 discloses a reinforced wooden structural member composed of a wooden substrate reinforced by a reinforcing material. The reinforced wooden structural member is composed of a substrate formed of a natural wood piece or laminated wood and having a through hole extending in the longitudinal direction thereof, and a reinforcing steel rod is installed through the through hole. Threads are formed at both ends of the reinforcing steel rod, and the reinforcing steel rod is fixedly secured to the reinforced wooden structural member by nuts threadably mounted thereon.

[Patent Literature 1] JP-Utility Model Publication No. 3152531

In such a reinforced wooden structural member, both ends of the reinforcing steel rod axially (longitudinally) extending through the substrate are fixedly secured by nuts via springed washers in cutout recesses formed in the end faces of the substrate. Thus, a tensioning force has been introduced into the reinforcing steel rod, and the reactive force of the tensioning force acts on the reinforced wooden structural member via the springed washers. Because wood has a lower elastic modulus than metals and so on, the contact face may be deformed when a large force is applied thereto from a metal member such as a washer. When the contact area of the metal member is increased to prevent such deformation, the structure by which the tensile member such as the reinforcing steel rod is fixed becomes large. Then, the structure by which the tensile member is fixed may be exposed from the side surfaces of the wooden material or may prevent an end of the wooden material from being joined to another member.

The present invention has been made in view of above circumstances, and it is, therefore, an object of the present invention to provide a wooden member assembly formed of a wooden material and configured to be easily joined to another member and to have a good appearance by decreasing the size of the fixation structure for a tensile member installed to improve the load bearing performance of the wooden member.

SUMMARY OF THE INVENTION

For the purpose of solving the above problems, the invention according to Aspect 1 provides a wooden member assembly, wherein metal screw members each including a cylindrical shaft portion having a through hole formed therein in an axial direction thereof and a blade spirally protruding from an outer peripheral surface of the shaft portion are axially threaded into a wooden member formed of a wooden material at two locations respectively, both ends of a tensile member are inserted through the through holes of the two screw members respectively, and a tensioning force has been introduced into the tensile member and the tensile member is fixed in such a way that a reactive force of the tensioning force acts on each of the screw members.

In this wooden member assembly, the reactive force from the tensile member into which a tensioning force has been introduced acts on the screw members and then transferred from the spirally protruding blades of the screw members to the wooden member over a wide range in the axial direction of the screw members. Thus, the bearing ability of the wooden member assembly against a bending moment or the like can be improved without providing large plates or the like at the ends of the wooden member. In other words, because the screw members can be embedded in the wooden member, the exposure of fixation portions at the ends of the wooden member can be reduced. In addition, the wooden member can be easily joined to another member even when the screw members are embedded in the ends thereof.

The invention according to Aspect 2 is the wooden member assembly according to Aspect 1, wherein a cutout is axially formed in each of ends of the wooden member from a part of each of the end faces thereof to a predetermined depth; each of the screw members is threaded into the wooden member through each of the cutouts; and each of the cutouts has such a size that allows introduction of a tensioning force into the tensile member and fixation of the tensile member to each of the screw members after each of the end faces of the wooden member is joined in abutting relationship with another member.

In this wooden member assembly, a tensioning force can be introduced into the tensile member and the tensile member can be fixed to the screw members by operation from inside the cutouts formed in the end faces of the wooden member even when the end faces of the wooden member are joined in abutment with the other members. Thus, because introduction or addition of a tensioning force can be made after the wooden member assembly is joined to the other members, a tensioning force can be introduced efficiently.

The invention according to Aspect 3 is the wooden member assembly according to Aspect 1 or Aspect 2, wherein a groove is formed, in the axial direction, in the wooden member except portions in the vicinity of both ends thereof; each of the screw members is threaded into a hole, the hole extending from each of both end faces of the wooden member or each of the cutouts of the wooden member to the groove, the hole being formed longer than the axial length of each of the screw members; and the tensile member is installed in the groove, the tensile member having both ends, each of the both ends inserted through the through hole of each of the two screw members.

In this wooden member assembly, the tensile member can be installed from the through hole of one of the screw members through the groove into the through hole of the other screw member. In other words, the tensile member inserted into the through hole of the screw member threaded into one end of the wooden member can be inserted into the through hole of the screw member threaded into the other end of the wooden member through the groove. Thus, the tensile member can be installed in the axial direction in the wooden member easily. In addition, it is difficult to cut a long axial hollow hole through a natural wood piece or a laminated wood formed by bonding a plurality of small cross-section wood pieces, whereas the groove can be easily cut in a natural wood piece or laminated wood to install the tensile member.

The invention according to Aspect 4 is the wooden member assembly according to Aspect 1 or Aspect 2, wherein each of the screw members is threaded from each of both end faces or the cutouts of the wooden member into each of hollow holes extending from each of the end faces or the cutouts through an upper, lower or side surface of the wooden member; and a tensile member having both ends inserted into the through holes of the screw members is directed from the hollow holes to the outside of the wooden member and extends along the wooden member.

In this wooden member assembly, an axial intermediate portion of the tensile member is located outside the cross-section of the wooden member. Thus, the wooden member can resist a large bending moment. In addition, because the hollow holes into which the tensile member is inserted can be short, the hollow holes used to install the tensile member in the wooden member can be formed easily and the tensile member can be installed easily.

The invention according to Aspect 5 is the wooden member assembly according to Aspect 1 or Aspect 2, wherein the wooden member is a laminated wood formed by bonding together a plurality of small cross-section members having a smaller cross-section than the wooden member; the small cross-section members are bonded together in such a way that a hollow hole extending in an axial direction of the wooden member is formed in the wooden member; each of the screw members is threaded into the hollow hole from each of end faces of the wooden member or through the cutouts; and the tensile member is installed in the hollow hole, the tensile member having both ends, each of the both ends inserted through the through hole of each of the two screw members.

In this wooden member assembly, the hollow hole can be easily formed in the axial direction when the small cross-section members are bonded together. Then, when the screw members are threaded into the end faces of the wooden member to establish communication with the hollow hole, the tensile member can be installed between the screw members through the hollow hole.

The invention according to Aspect 6 is the wooden member assembly according to any one of Aspect 1 to Aspect 4, wherein the through hole of each screw member has an inside diameter which increases toward the end face on the side from which the tensile member inserted into the through hole extends toward the other screw member.

In this wooden member assembly, the inside diameter of the through hole of each screw members is increased toward the end from which tensile member extends toward the other screw member, the tensile member can be easily inserted into the through hole from the distal end of the screw member threaded into the wooden member. For example, the tensile member can be easily inserted into the through hole of one screw member from one of the end faces of the wooden member and inserted into the through hole of the screw member threaded into the opposite end of the wooden member through the hollow hole formed in the wooden member.

According to the wooden member assembly of the present invention, the fixation structure for the tensile member installed to improve the load-bearing performance of the wooden member formed of a wooden material can be small in size so that the wooden member can be easily joined to another member and have good appearance.

This application is based on the Patent Applications No. 2012-055113 filed on Mar. 12, 2012 in Japan, the contents of which are hereby incorporated in its entirety by reference into the present application, as part thereof.

The present invention will become more fully understood from the detailed description given hereinbelow. The other applicable fields will become apparent with reference to the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the patent claims constitute, therefore, a part of the present invention in the sense of doctrine of equivalents.

DETAILED DESCRIPTION OF THE PREFERRED EMBODIMENT

Description is hereinafter made of embodiments of the present invention with reference to the drawings.

Figures 1A, 1B, 1C, 1D:
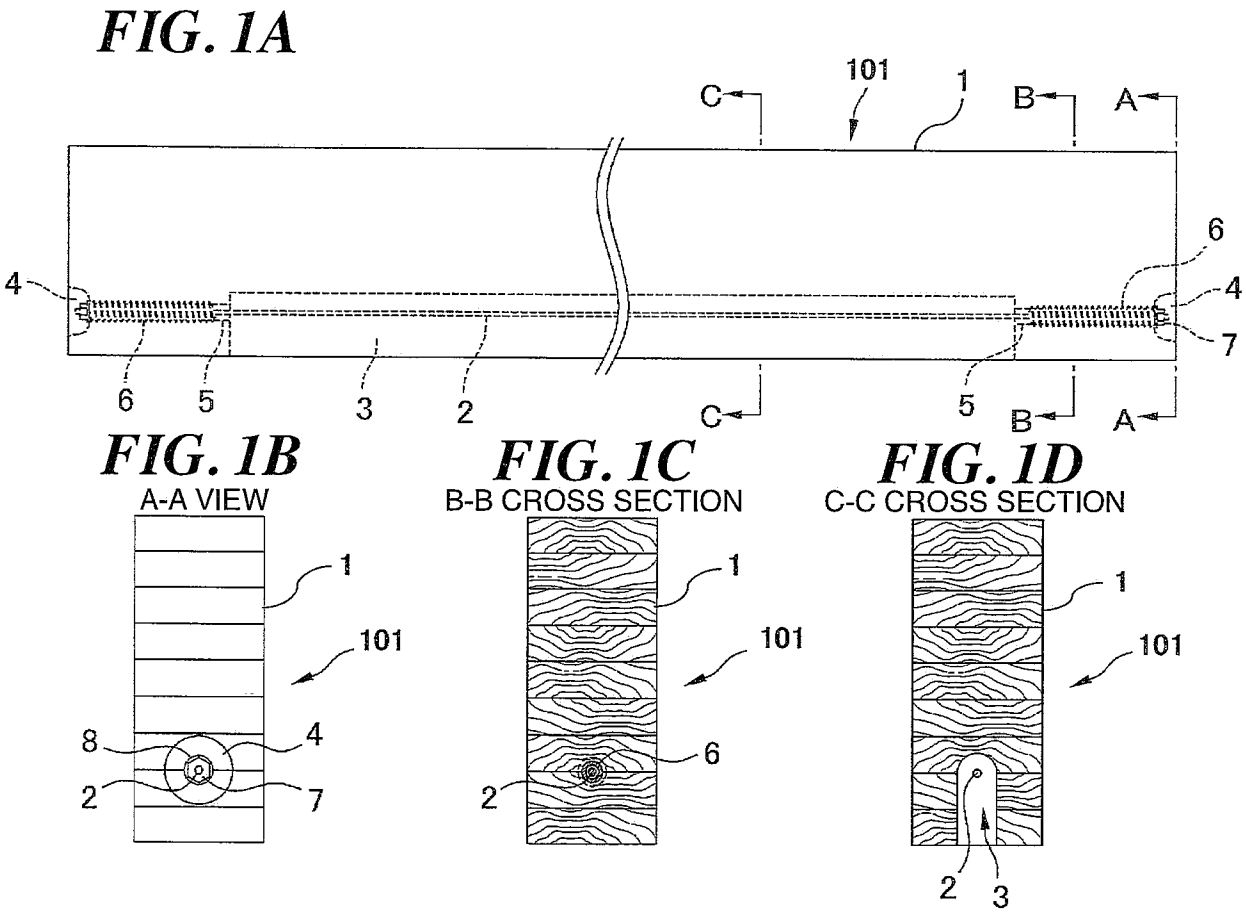
FIG. 1A shows a schematic side view, illustrating a wooden member assembly according to one embodiment of the present invention.
FIG. 1B shows a view seen in the direction of arrows A-A in the side view of FIG. 1A.
FIG. 1C shows a cross-sectional view taken along the line B-B in the side view of FIG. 1A.
FIG. 1D shows a cross-sectional view taken along the line C-C in the side view of FIG. 1A.
Figure 2B:
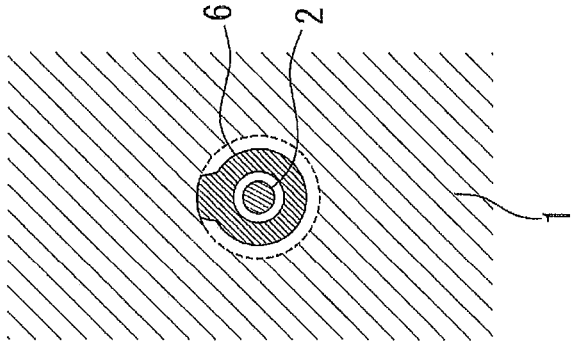
FIG. 2B shows a cross-sectional view seen in the direction of the axis of the part of the wooden member assembly into which a screw member is threaded, as shown in FIG. 1A.
Figure 2A:
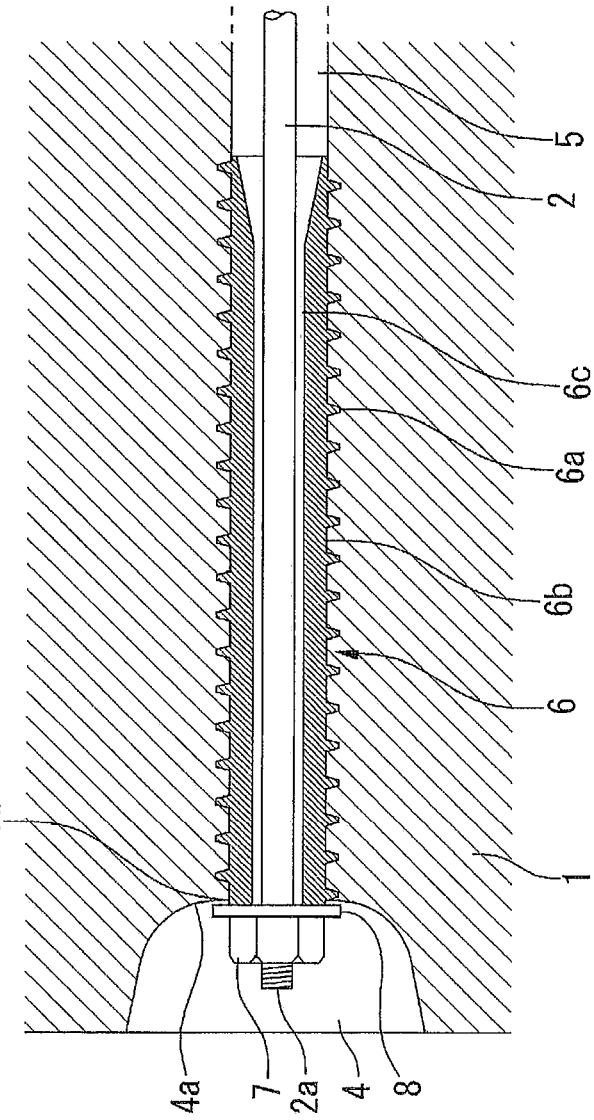
FIG. 2A shows a cross-sectional view along the axis of the part of the wooden member assembly into which a screw member is threaded, as shown in FIG. 1A.

FIG. 1A shows a schematic side view illustrating a wooden member assembly according to one embodiment of the present invention, FIG. 1B is a view seen in the direction of allows A-A in the side view, a cross-sectional view taken along the line B-B and a cross-sectional view taken along the line C-C. FIG. 2A shows a cross-sectional view along the axis of the part of the wooden member assembly into which a screw member is threaded, as shown in FIG. 1A, and FIG. 2B is a cross-sectional view seen in the direction of the axis of the part.

As shown in FIG. 1A, a wooden member assembly 101 includes a wooden member 1, a steel rod 2 as a tensile member, and screw members 6. Specifically, the steel rod 2 is axially installed in the wooden member 1, and prestress has been introduced into the wooden member 1 by the tensioning force of the steel rod 2.

The wooden member 1 which constructs wooden member assembly 101 is formed of a laminated wood formed by bonding together a plurality of small cross-section members each composed of a plate-like wooden material, and, in this embodiment, has cross-sectional dimensions of about 30 cm in height and about 10.5 cm in width. The length may be set to, for example, 364.0 cm or 546.0 cm, as appropriate depending on the location of use.

The wooden member 1 has a bottom surface in which a groove 3 is axially formed along the entire length thereof except for predetermined length-portions at both ends. A cutout recess 4 is formed in a lower part of each end face of the wooden member 1, and a hole 5 extending axially from the bottom of each cutout recess 4 is communicated with the groove 3. A screw member 6 is threaded into the hole 5 from the end face side. Because the holes 5 into which the screw members 6 are threaded are axially formed in the wooden member 1 over a range longer than the length of the screw members 6, the screw members 6 are embedded in the wooden member 1.

As shown in FIG. 1B, the cutout recess 4 has a circular shape with a diameter greater than that of the hole 5, and the diameter of the cutout recess 4 is smaller than the width of the end face of the wooden member 1. Thus, when the wooden member assembly 101 is seen from a side, the cutout recess 4 and the embedded screw member 6 cannot be seen.

As shown in FIG. 2A, the screw member 6 has a cylindrical shaft portion 6*b* made of a metal and a blade 6*a* protruding in a spiral fashion from the outer periphery of the cylindrical shaft portion 6*b*. The screw member 6 has a through hole 6*c* along its central axis, and the inside diameter of the through hole 6*c* is increased toward the end face at one end. The screw member 6 is fixedly threaded into the hole 5 formed in the wooden member 1 with the larger inside diameter side of the through hole 6*c* facing the center of the wooden member 1. The blade 6*a* is engaged with the wooden member 1 to transfer an axial force applied to the screw member 6 to the wooden member 1.

The screw member 6 is threaded into the hole 5 of the wooden member 1 from the side of the cutout recess 4 after a spiral thread is cut in the hole 5.

The steel rod 2 has both ends 2*a* having a male thread on the outer periphery. The steel rod 2 has one end inserted through the through hole 6*c* of the screw member 6 threaded into one end of the wooden member 1, and extends in the groove 3 with the other end inserted through the through hole 6*c* of the screw member 6 threaded into the other end of the wooden member 1. The steel rod 2 is locked to the screw members 6 by nuts 7 threadedly engaged with the male threads at both ends thereof via washers 8 in the two cutout recesses 4 of the wooden member 1. Thus, when the nuts 7 are fastened tightly or when the nuts 7 are fastened after introducing a tension into the steel rod 2 by means of a jack or the like, the both ends of the steel rod 5 are fixed to the wooden member 1 via the screw members 6 with a tensioning force introduced into the steel rod 5.

In the wooden member assembly 101 constituted as described above, the reactive force from the steel rod 2, into which a tensioning force has been introduced, is transferred from the nuts 7 to the screw members 6 via the washers 8 and from the blade 6*a* formed on the outer periphery of the screw member 6 to the wooden member 1. Therefore, a compressive stress is generated in the vicinity of the lower edge of the wooden member 1, and the wooden member assembly 101 has a high load bearing ability against a bending moment caused by the load imposed on the wooden member 1 when the wooden member 1 is used as a beam or the like. In addition, because the reactive force from the steel rod 2, into which a tensioning force has been introduced, is transferred from the peripheral surfaces of the screw members 6, which are long in the axial direction, to the wooden member 1, large stress is prevented from being concentrated on a part of the wooden member 1. Further, the outside diameter of the screw members 6 can be small because the screw members 6 are formed long in the axial direction, the screw members 6 can be embedded in the wooden member 1 and the cutout recesses 4 in which the fixture portions are housed can be small, resulting in a structure in which the fixture portions are not exposed as viewed from a side.

Moreover, the steel rod 2 is placed in the groove 3, which opens downward in the bottom surface of the wooden member 1, between both ends of the wooden member 1 into which the screw member 6 are threaded. Thus, after inserting an end 2*a* of the steel rod 2 through the through hole 6*c* of one of the screw members 6 into the groove 3, the end can be inserted into the through hole 6*c* of the other screw member 6 by handling the steel rod 2 in the groove 3. Therefore, the steel rod 2 can be installed along the axis of the wooden member 1 efficiently.

The groove 3 may be formed by cutting predetermined portions of the small cross-section members in advance so that the groove 3 can be formed when the small cross-section members are bonded together, or may be formed in the wooden member 1 obtained by bonding the small cross-section members together.

Referring to FIGS. 3A to 3D, a second embodiment of a wooden member assembly according to the present invention is next described.

Figures 3A, 3B, 3C, 3D:
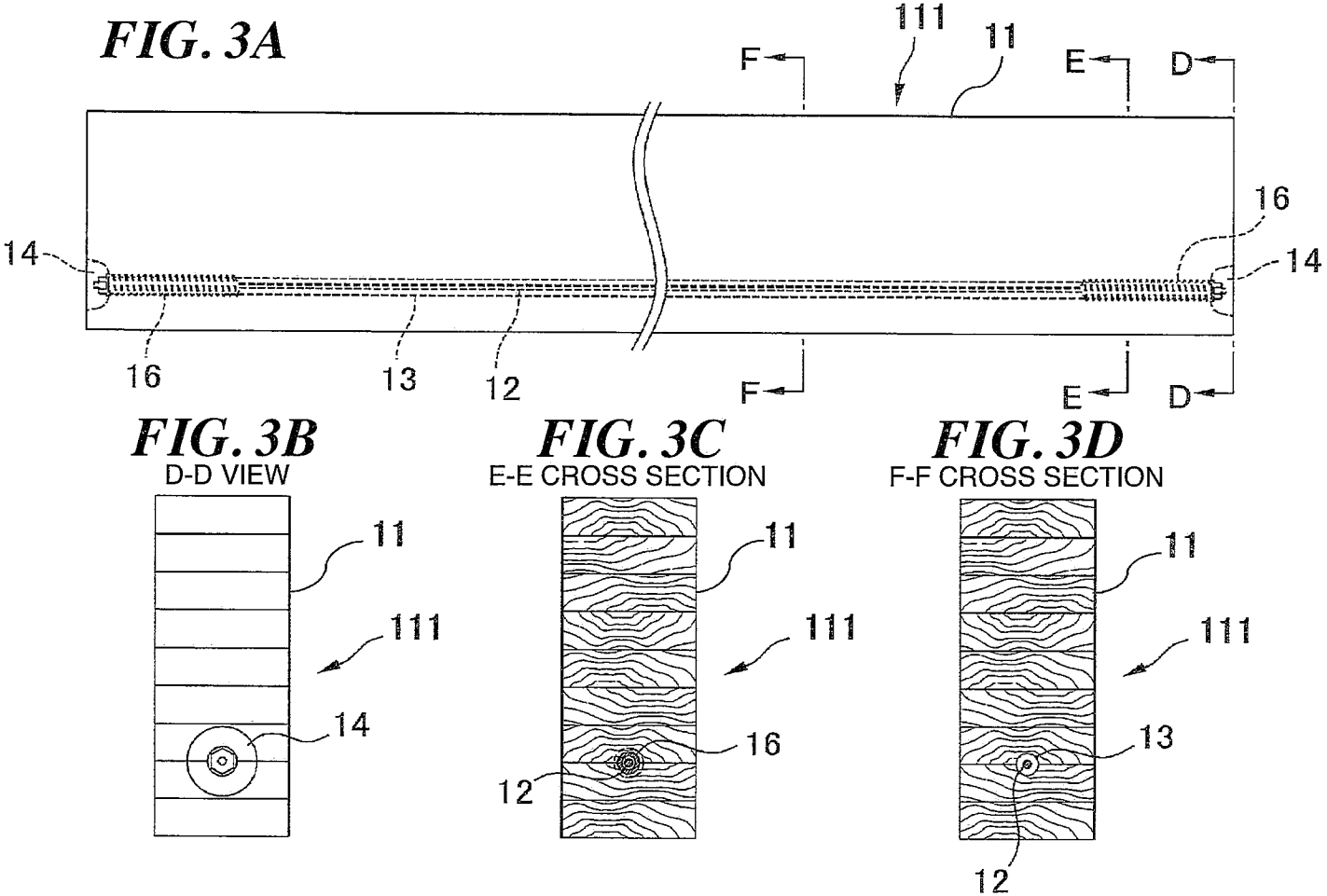
FIG. 3A shows a schematic side view, illustrating a wooden member assembly according to a second embodiment of the present invention.
FIG. 3B shows a view seen in the direction of arrows D-D in the side view of FIG. 3A.
FIG. 3C shows a cross-sectional view taken along the line E-E in the side view of FIG. 3A.
FIG. 3D shows a cross-sectional view taken along the line F-F in the side view of FIG. 3A.

A wooden member assembly 111 has a hollow hole 13 axially extending therethrough as shown in FIGS. 3A and 3D in place of the groove 3 formed in the wooden member 1 of the first embodiment. Because the wooden member 11 is constituted in the same way as the first embodiment except for the hollow hole 13, description is mainly made of the hollow hole 13 and description of other configurations is omitted.

The hollow hole 13 is provided to receive screw members 16 at both ends of the wooden member 11 and to install a steel rod 12 between the screw members 16. The hollow hole 13 is formed by processing the small cross-section members in advance before the small cross-section members are bonded together to form a laminated wood.

Figure 4A:
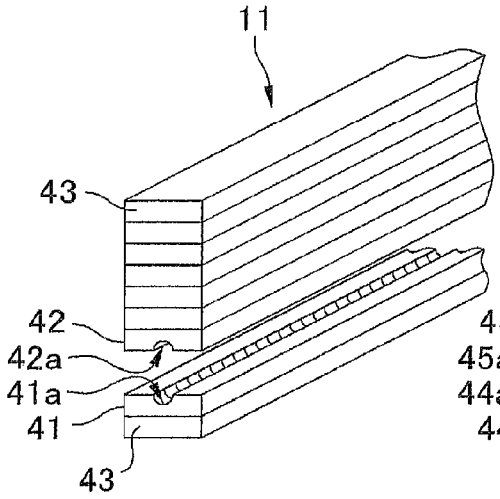
FIG. 4A shows schematic perspective views, illustrating a method for forming the hollow hole of the wooden member constructing the wooden member assembly shown in FIG. 3A.

As shown in FIG. 4A, for example, recesses 41*a* and 42*a* having a semi-circular cross-section are axially formed in advance in two small cross-section members 41 and 42, respectively, which will be located at the position of the hollow hole 13 when a plurality of plate-like wooden small cross-section members are bonded together. Then, when the small cross-section members 41 and 42 are bonded together with the semi-circular recesses 41*a* and 42*a* facing each other and the other small cross-section members 43 are bonded into a unitary body, the hollow hole 13 having a generally circular cross-section is formed at the location where the screw members 16 and the steel rod 12 will be installed.

Figure 4B:
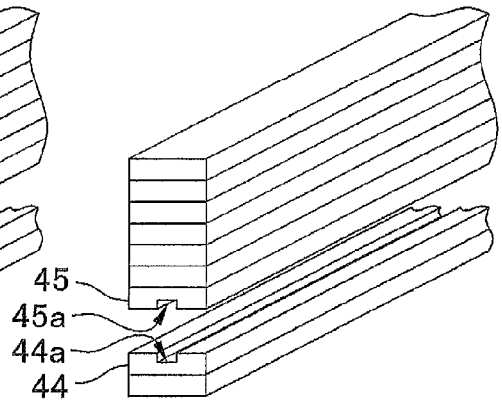
FIG. 4B shows schematic perspective views, illustrating a second method for forming the hollow hole of the wooden member constructing the wooden member assembly shown in FIG. 3 A.

Alternatively, as shown in FIG. 4B, the hollow hole 13 may be formed by cutting rectangular recesses 44*a* and 45*a*, instead of the semi-circular recesses, in two small cross-section members 44 and 45, respectively, and bonding the small cross-section members 44 and 45 with the recesses 44*a* and 45*a* facing each other.

Figure 4C:
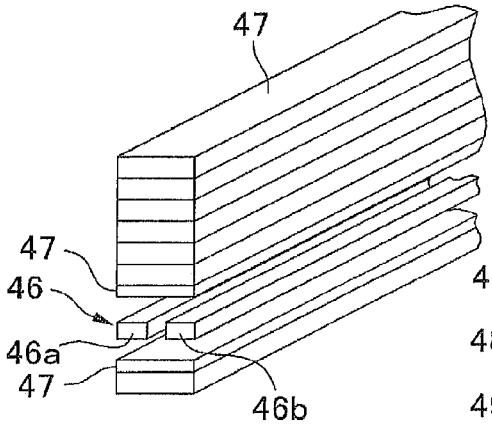
FIG. 4C shows schematic perspective views, illustrating a third method for forming the hollow hole of the wooden member constructing the wooden member assembly shown in FIG. 3 A.

In the method shown in FIG. 4C, the small cross-section member 46 which will be placed at a location where the hollow hole 13 will be formed is axially divided into halves, and the resulting small cross-section members 46*a* and 46*b* are placed at a predetermined distance with their divided surfaces facing to each other. The hollow hole 13 is formed by stacking other small cross-section members 47 on both sides of the small cross-section members 46*a* and 46*b* placed at a distance as described above and bonding the small cross-section members together. The distance between the divided surfaces placed facing each other can be adjusted based on the cross-sectional dimensions of the hollow hole 13 to be formed, and the thickness of the small cross-section member 46 to be divided may be adjusted.

As shown in FIG. 4B and FIG. 4C, when the hollow hole 13 is formed to have a rectangular cross-sectional shape, the diagonal length of the cross-section of the hollow hole 13 is preferably smaller than the outside diameter of the shaft portions of the screw members 16 which will be threaded into the ends of the wooden member 11. Then, the portions into which the screw members 16 will be inserted at ends of the wooden member 11 are cut to increase the cross-section of the hollow holes to form a circular cross-section having generally the same diameter as the outside diameter of the shaft portions of the screw members 16. When a spiral threads are cut in the inner peripheral surfaces of the hollow hole 13, the screw members 16 can be threaded into the wooden member 11.

Figure 4D:
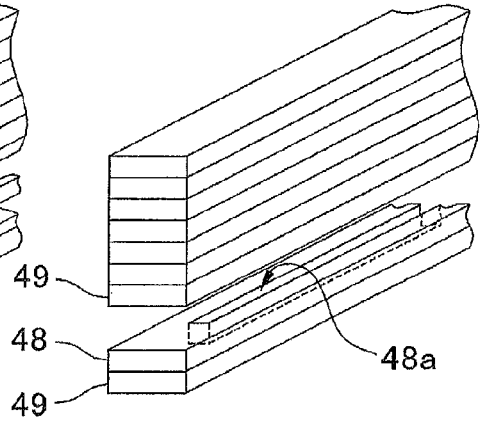
FIG. 4D shows schematic perspective views, illustrating a fourth method for forming the hollow hole of the wooden member constructing the wooden member assembly shown in FIG. 3 A.

Alternatively, the hollow hole 13 may be formed by providing a recess which is long in the axial direction as shown in FIG. 4D or a through hole 48*a* which is long in the axial direction in a small cross-section member 48 along the entire length thereof except the portions at both ends into which the screw member 16 will be threaded, and sandwiching the small cross-section member 48 between other small cross-section members 49 and bonding the small cross-section members together. When the wooden member 11 as a laminated wood is formed by this method, holes into which the screw members will be threaded are bored from the end faces until the holes reach the hollow hole 13 after the small cross-section members 48 and 49 are bonded together into a unitary body.

The cutout recesses 14 with a circular cross-section coaxial with the hollow hole 13 are formed around the hollow hole 13 in the end faces of the laminated wood having the hollow hole 13 formed by processing the small cross-section members 41, 42, 44, 45, 46 and 48 before the small cross-section members are bonded together. Then, after threading the screw members 16 into the hollow hole 13 through the cutout recesses 14, the steel rod 12 is inserted into the through hole of one of the screw members 16 from one end face of the laminated wood. The steel rod 12 inserted through the through hole of the screw member 16 is inserted into the through hole of the screw member 16 threaded into the other end of the laminated wood through the hollow hole 13 formed in the laminated wood. At this time, because the inside diameter of the through hole is increased at the distal end of the screw member 16 threaded into the laminated wood, i.e., at the end communicated with the hollow hole 13, as shown in FIG. 2, the steel rod 12 can be easily inserted into the through hole of the screw member 16.

Figures 5A, 5B, 5C:
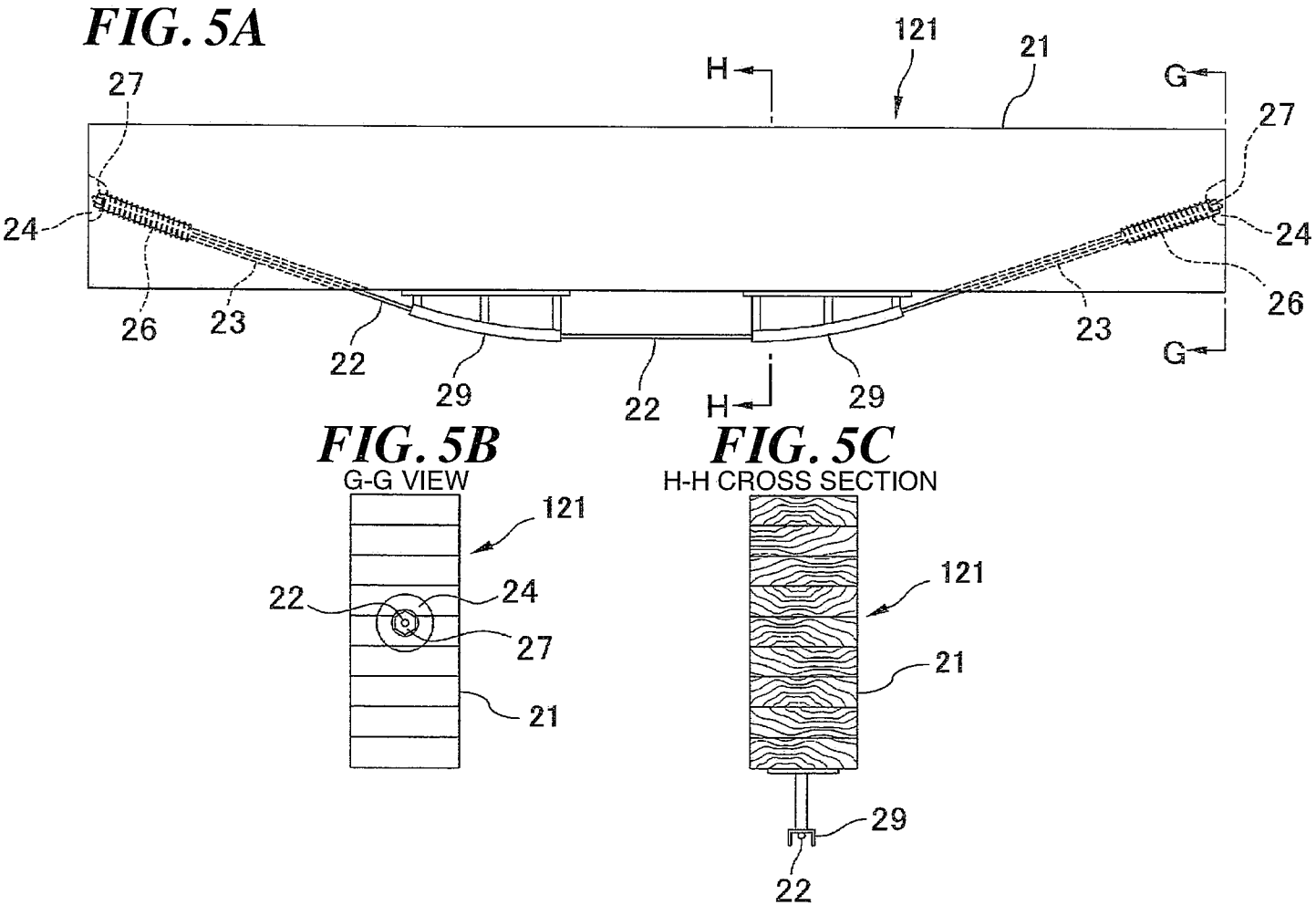
FIG. 5A shows a schematic side view, illustrating a wooden member assembly according to a third embodiment of the present invention.
FIG. 5B shows a view seen in the direction of arrows G-G in the side view of FIG. 5A.
FIG. 5C shows a cross-sectional view taken along the line H-H of FIG. 5A.

FIGS. 5A, 5B and 5C respectively show a side view, illustrating a wooden member assembly according to a third embodiment of the present invention, a view seen in the direction of allows G-G in the side view, and a cross-sectional view taken along the line H-H.

A wooden member assembly 121 is different from the second embodiment shown in FIG. 3A in the locations where the screw members 26 are threaded into the wooden member 21 and the layout of the steel rod 22 as shown in FIGS. 5A and 5B but other configurations thereof are the same as those of the wooden member assembly 111 shown in FIG. 3A and the same screw members 26 and steel rod 22 are used. Thus, description is mainly made of the layout of the screw members 26 and the steel rod 22 in this embodiment, and the description of other configurations is omitted.

In the wooden member assembly 121, hollow holes 23 into which the steel rod 22 is inserted are formed obliquely downward from a position roughly at the center of each end face of the wooden member 21 in the height direction thereof toward the bottom surface of the wooden member 21. A cutout recess 24 is formed around the opening of the hollow hole in each end face, and screw member 26 is threaded into the hollow hole 23 through the cutout recess 24.

Because the hollow hole 23 is formed longer than the axial length of the screw member 26 threaded thereinto, the screw member 26 is almost entirely embedded in the hollow hole 23.

The steel rod 22 extends from one of the cutout recesses 24 through the through hole of the screw member 26 and the hollow hole 23 and once sticks out of the wooden member 21 through the bottom surface thereof. Then, the steel rod 22 extends axially along the bottom surface of the wooden member 21 into the hollow hole 23 formed in the other end of the wooden member 21 and the through hole of the screw member 26 threaded into the hollow hole 23. Each end of the steel rod 22 is locked to the end face of the screw member 26 via a washer by a nut 27 threadedly engaged with the male thread formed at the end of the steel rod 22 in the cutout recess 24 as in the case of the wooden members assembly 101 and 111 shown in FIG. 1A and FIG. 3A, respectively.

A saddle 29 which is in contact with the bottom face of the wooden member 21 and supports the steel rod 22 in such a way as to surround the steel rod 22 from above is provided between the steel rod 22 placed outside the wooden member 21 and the wooden member 21 as shown in FIGS. 5A and 5C, and the steel rod 22 extends at a predetermined distance from the wooden member 21.

A tensioning force is introduced into the steel rod 22 installed as described above by fastening the nuts 27 in the cutout recesses 24 of the wooden member 21. Alternatively, the steel rod 22 may be fixed by fastening the nuts 27 after introducing a tensioning force by means of a jack.

Because the wooden member 21 reinforced by the steel rod 22 into which a tensioning force has been introduced, a compressive stress can be effectively introduced in the vicinity of the lower edge of the wooden member 21. In addition, the wooden member 21 has a high load bearing ability because the steel rod 22 located under the wooden member 21 resists a bending moment caused by the load imposed on the wooden member assembly 121.

A joint structure by which the wooden member assembly constituted as described above is joined to another structural member is next described.

Figure 6:
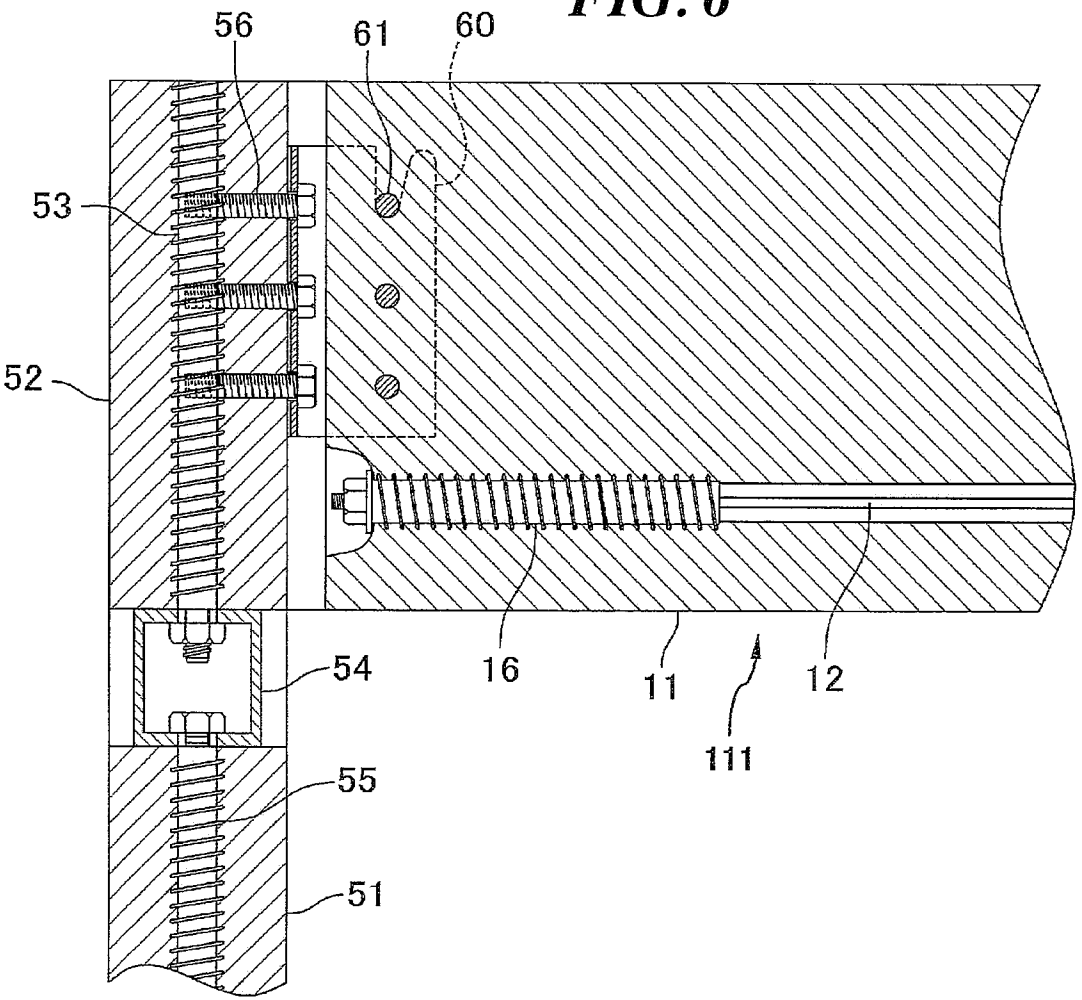
FIG. 6 is a cross-sectional view, illustrating a joint structure between the wooden member assembly shown in FIG. 3A and another structural member.
Figure 7:
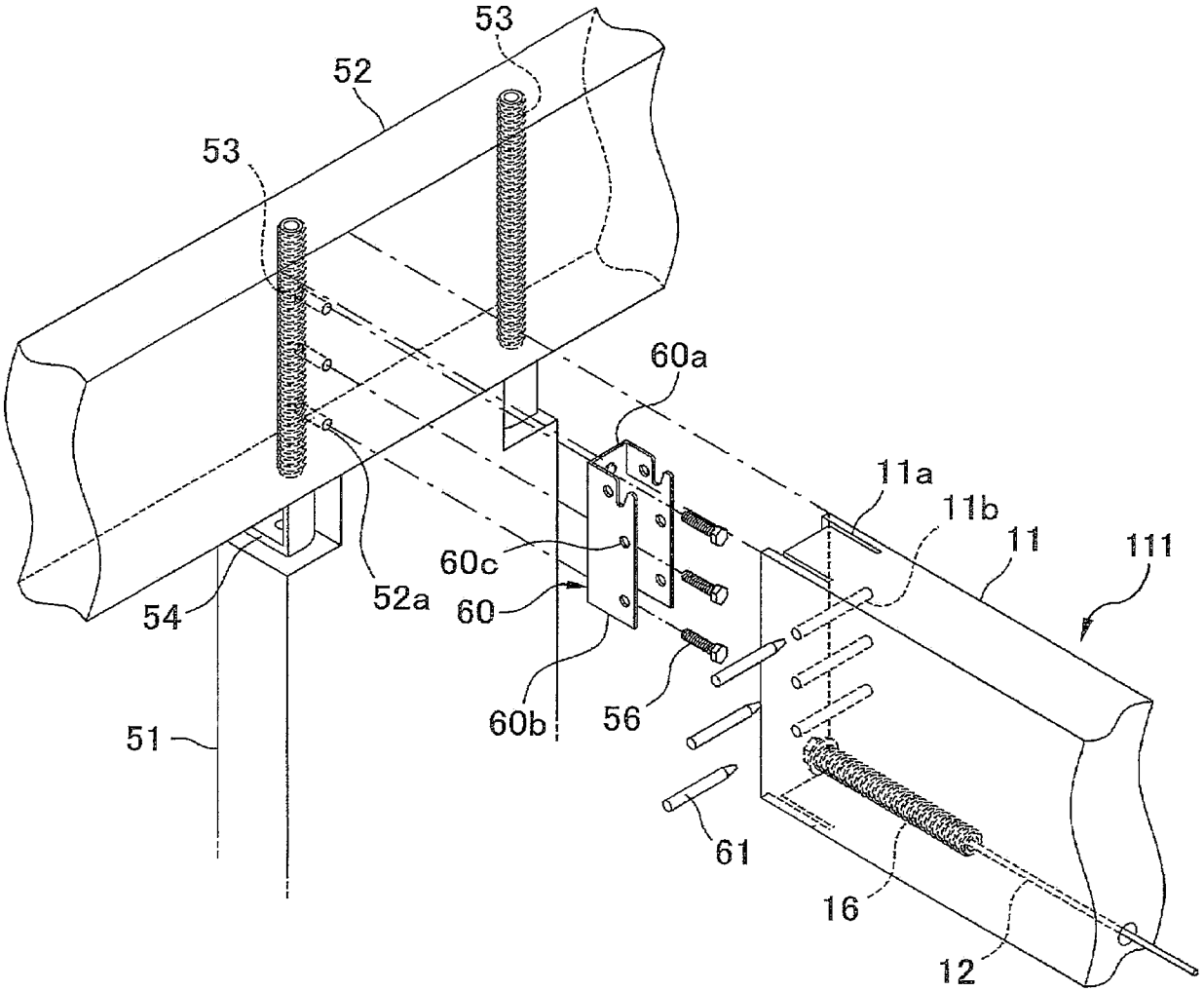
FIG. 7 is an exploded perspective view of the joint structure shown in FIG. 6.

FIG. 6 is a cross-sectional view, illustrating an example of the structure by which the wooden member assembly 111 according to the second embodiment shown in FIG. 3A is joined to a beam 52 using wooden material, and FIG. 7 is an exploded perspective view illustrating the structure of this joint.

As shown in these drawings, the joint structure is used to join an end face of the wooden member assembly 111 including a steel rod 12 shown in FIG. 3A in abutting relationship with a side of a beam 52 supported on a column 51.

The beam 52 is a flat member with a cross-sectional shape having a vertical length greater than a horizontal length (width) as shown in FIG. 6 and FIG. 7 just like the wooden member 11.

The column 51 also has a flat rectangular cross-sectional shape. The cross-section has a length longer in the axial direction of the beam 52 than that in the perpendicular direction thereto. The column 51 is joined to the beam 52 in such a way that a bending moment can be transferred between the column 51 and the beam 52 via a screw member 53 for beam threaded into the beam 52, a box-like metal joint device 54 and a screw member 55 for column (not shown in FIG. 7) threaded axially into the column 51.

The beam 52 and the wooden member assembly 111, into which a tensioning force has been axially introduced, are joined to each other as described below.

One of two screw members 53 for beam inserted into the beam 52 to join the column 51 to the beam 52 has screw holes extending perpendicular to the axis thereof at an longitudinal intermediate portion thereof. The beam 52 has horizontal holes 52*a* extending from a side thereof to the screw holes of the screw member 53 for beam, and a beam receiving device 60 is secured to a side of the beam 52 by bolts 56 threaded into the screw member 53 for beam through the horizontal holes 52*a*.

The beam receiving device 60 has a first joint plate portion 60*a* which abuts against a side of the beam 52, and two second joint plate portions 60*b* extending perpendicular to the first joint plate portion 60*a* from both edges thereof. The dimension of the beam receiving device 60 in the height direction thereof is smaller than the dimension of the wooden member 11 in the height direction thereof.

The wooden member 11 has two vertical slits 11*a* parallel to the axis thereof in one end, and the second joint plate portions 60*b* of the beam receiving device are inserted into the slits 11*a*. Pins 61 are inserted into horizontal holes 11*b* formed in the wooden member 11 from a side of the wooden member 11 so that the pins 61 can extend through pin holes 60*c* formed through the second joint plate portions 60*b* to couple the wooden member 11 to the beam receiving device 60.

A steel rod 12 is installed at a predetermined height from the lower edge in the wooden member 11, and a screw member 16 is axially threaded into an end of the wooden member 11. The beam receiving device 60 is inserted into the slits 11*a* above the location where the screw member 16 is threaded into the wooden member 11, and the pins 61 are inserted from a side of the wooden member 11 above the location where the screw member 16 is installed.

As described above, because the wooden member assembly 111 is joined to a side of the beam 52 via the beam receiving device 60, the shear force which is applied between the wooden member assembly 111 and the beam 52 is transferred to the beam 52 via the pins 61 inserted into the wooden member 11 from a side thereof, the beam receiving device 60, the bolts 56 and the screw member 53 inserted into the beam 52.

The wooden member assembly 101 shown in FIG. 1A as a first embodiment can be joined to the beam 52 in the same manner.

Figure 8:
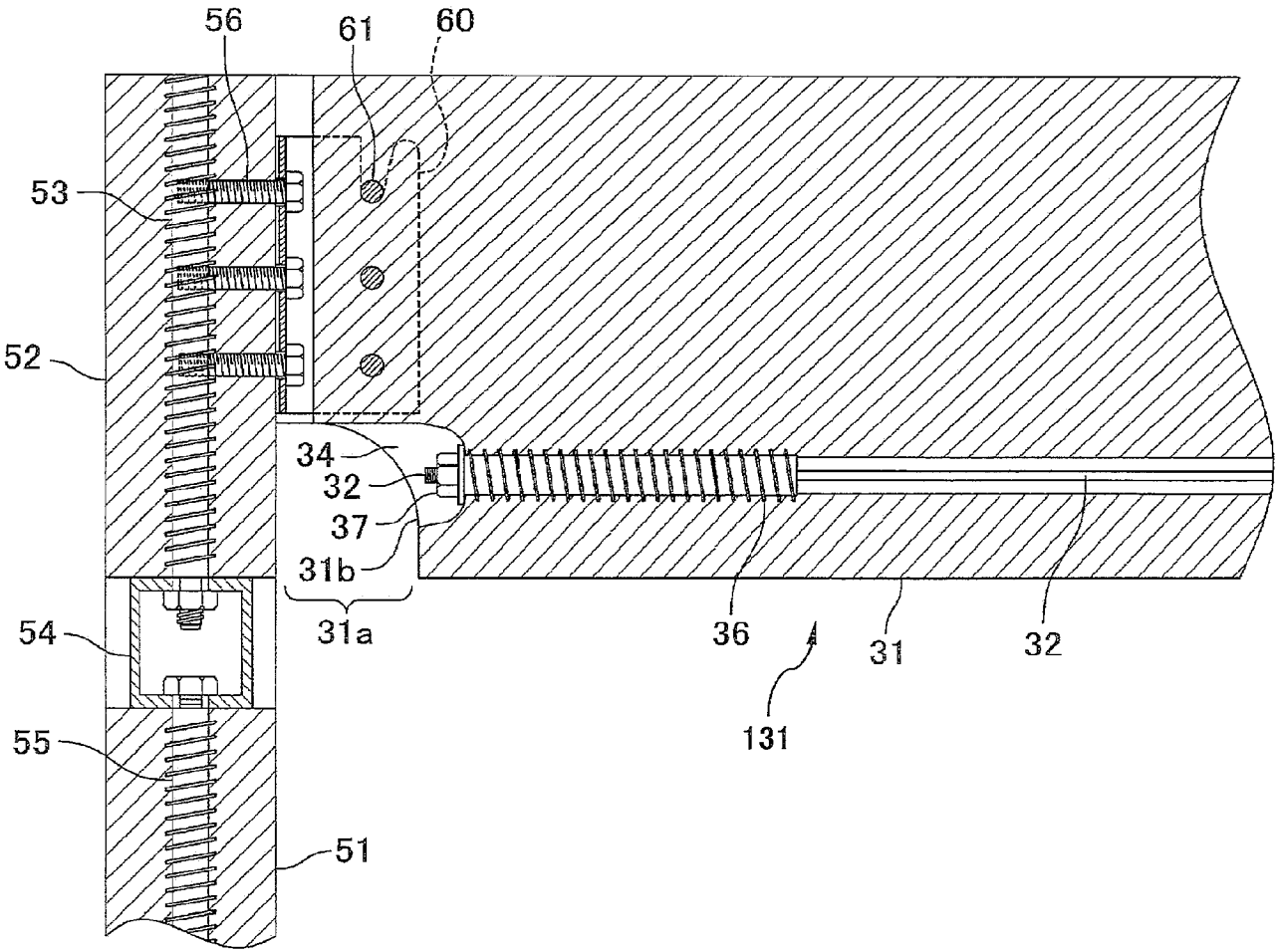
FIG. 8 is a cross-sectional view, illustrating another example of a joint structure between a wooden member assembly according to an embodiment of the present invention and another structural member.

At both ends of the wooden member assembly according to the embodiment of the present invention, cutout 31 a may be formed in both ends of the above wooden member assembly by cutting a lower part of the cross-section of the wooden member 31 along the entire width thereof as the wooden member assembly 131 shown in FIG. 8, When such cutouts 31*a* are formed, each screw member 36 which is axially threaded into the wooden member 31 is embedded at a location slightly on the side of the center of the wooden member 31 from the end face, and a cutout recess 34 is formed in the axial direction of the steel rod 32 to be installed in a surface 31*b* formed by cutting an end of the wooden member 31 in such a way that the cross-section decreases upward from the lower edge. Then, the screw member 36 is axially threaded into the wooden member 31 from the cutout recess 34 and the end of the steel rod 32 is locked to the screw member 36 by a nut 37.

The beam receiving device 60 used to join the wooden member 31 to the beam 52 as another member can be inserted into slits formed above the cutout 31*a* and used to join the wooden member 31 to another structural member in the same manner as in the joint structure shown in FIG. 6 and FIG. 7.

The wooden member assembly 131 joined in this manner allows a tool used to rotate the nut 37 or the like to be inserted into the cutout recess 34 through the cutout 31*a* to introduce a tensioning force into the steel rod 32 even after being joined to another structural member. In addition, even when a tensioning force has been introduced into the wooden member assembly 131 before it is joined, a tensioning operation can be carried out again to introduce an additional tensioning force.

Figure 9:
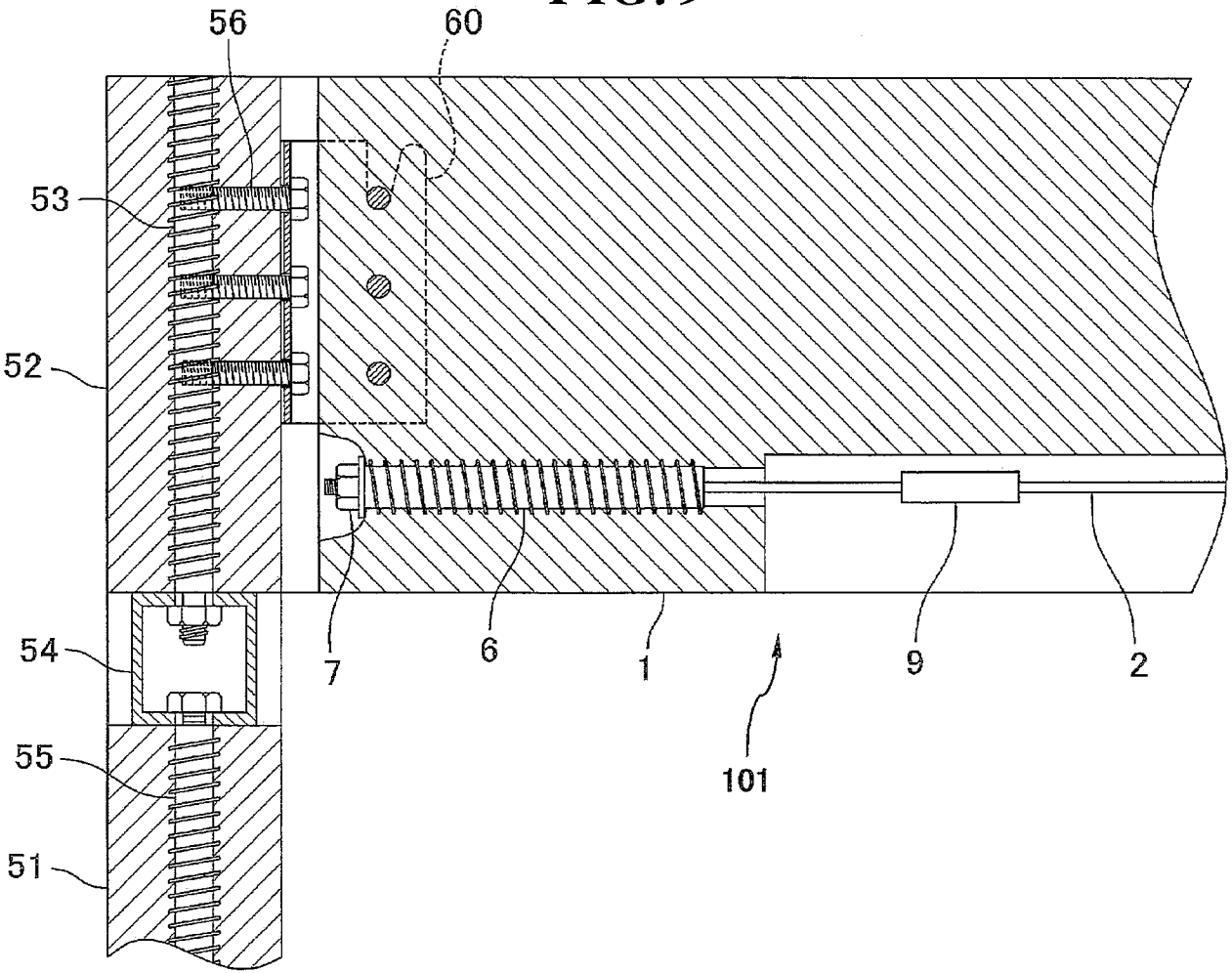
FIG. 9 is a cross-sectional view, illustrating another example of a wooden member assembly joined using the joint structure shown in FIG. 6.

In the case of the wooden member 1 having a groove 3 opening downward in the bottom surface and a steel rod 2 as a tensile member installed in the groove as shown in FIGS. 1A and 1D, the steel rod 2 may have a turnbuckle 9 as shown in FIG. 9. A tensioning force or an additional tensioning force can be introduced into the steel rod 2 by rotating the turnbuckle 9 in the groove 3 formed in the wooden member 1 even after the wooden member assembly 101 is joined to another structural member.

Figure 10:
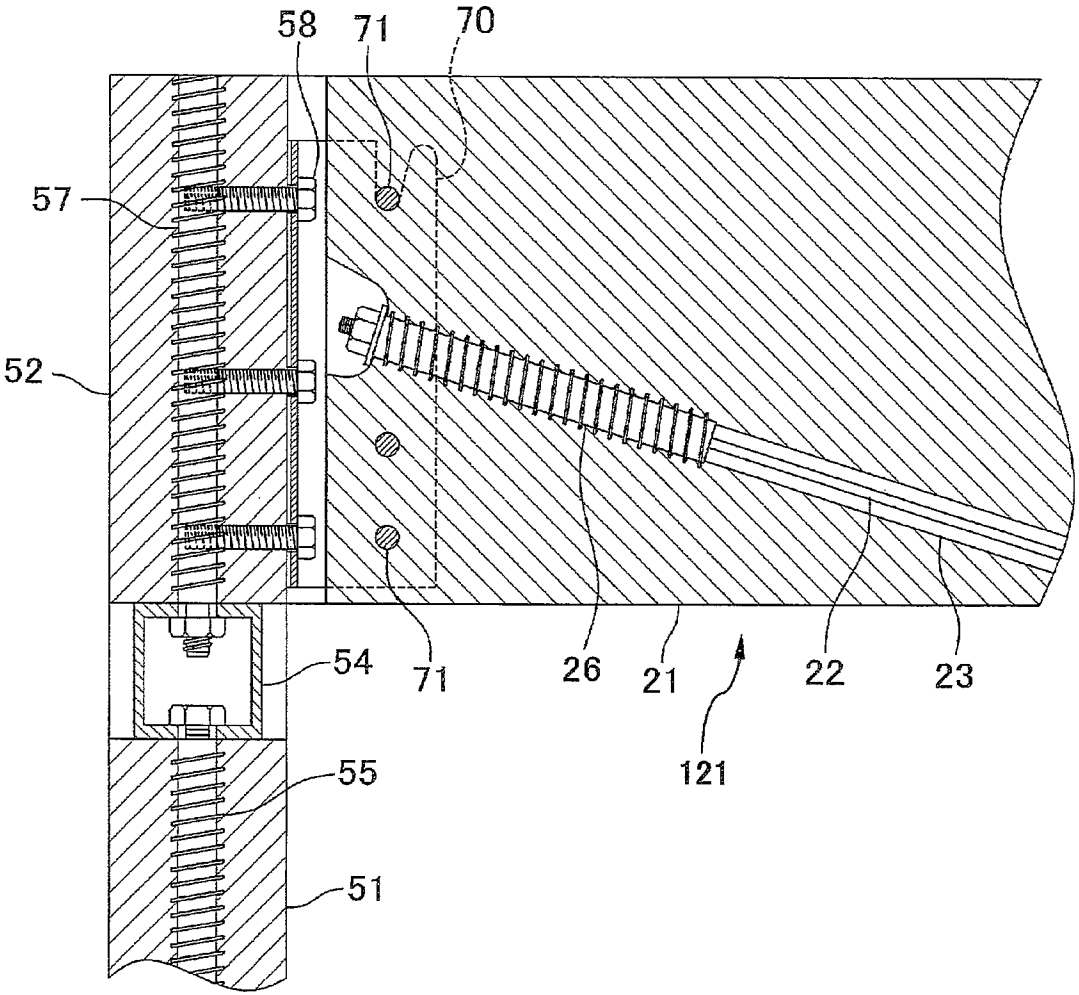
FIG. 10 is a cross-sectional view, illustrating a joint structure between the wooden member assembly shown in FIG. 5A and another structural member.
Figure 11:
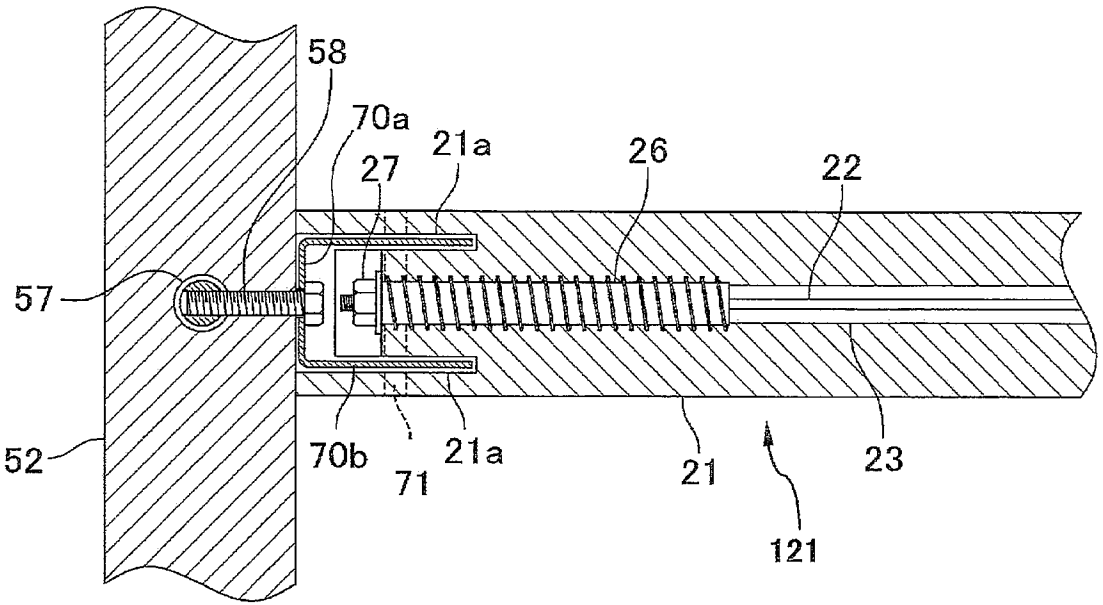
FIG. 11 is a plan cross-sectional view of the joint structure shown in FIG. 10.

FIG. 10 is a cross-sectional view illustrating an example of the structure by which the wooden member assembly 121 according to a third embodiment shown in FIG. 5A is joined to the beam 52 as another structural member. FIG. 11 is a horizontal cross-sectional view of the same joint structure.

The wooden member assembly 121 is joined to the beam 52 supported by the column 51 via a beam receiving device 70 in the same manner as in the joint structure shown in FIG. 6 and FIG. 7. The beam receiving device 70 has a configuration similar to that of the beam receiving device 60 used to join the wooden member assembly 111 according to the second embodiment, and has a first joint plate portion 70*a* which abuts against a side of the beam 52 and two second joint plate portion 70*b* extending perpendicular to the first joint plate portion 70*a* from both edges thereof. The beam receiving device 70 is secured to a side of the beam 52 by bolts 58 threadedly engaged with a screw member 57 for beam inserted into the beam 52.

As shown in FIG. 10, the dimension of the beam receiving device 70 in the height direction thereof is larger than that of the beam receiving device 60 used in the joint structure shown in FIG. 6 and FIG. 7, and the beam receiving device 70 extends to a position close to the lower edge of the wooden member 21.

The steel rod 22 installed in the wooden member 21 is locked to a screw member 26 threaded into the wooden member 21 at approximately half the height thereof. Thus, while the beam receiving device 70 extends across the location where the screw member 26 is threaded into the wooden member 21, the screw member 26 can be threaded into the wooden member 21 between two slits 21*a* formed in the wooden member 21 as shown in FIG. 11, Then, the wooden member 21 can be coupled to the beam receiving device 70 by pins 71 inserted into horizontal holes formed above and below the location where the screw member 26 is threaded into the wooden member 21.

The present invention is not limited to the embodiments described above, and may be implemented in a different forms within the scope of the present invention.

For example, the dimensions of the wooden member are not limited to the dimensions described in the above embodiments, and its cross-sectional dimensions and axial dimension may be determined as appropriate. In addition, the wooden member may be a laminated wood formed by bonding small cross-section members together or a natural wood piece, or may be a different wooden member composed mainly of wood.

The tensile member may be a steel wire or steel strand instead of the steel rod, or may be a tensile member formed by twisting synthetic resin fibers such as aramid fibers. The tensile member may be locked to the screw members by using wedges or by filling a synthetic resin in the through holes of the screw members and solidifying the synthetic resin instead of by using nuts threadably mounted on the tensile member as described above.

In addition, the structure by which the wooden member assembly according to the embodiment of the present invention is joined to another structural member is not limited to the structures described above, and the wooden member may be joined to various members in various forms.

In the joint structures shown in FIG. 6 to FIG. 11, the screw member 53 or 57 is vertically threaded into the beam 52 to which the wooden member assembly according to the embodiment of the present invention is joined and the beam receiving device 60 or 70 is secured to the beam 52 by the bolts 56 or 58 threadeadly engaged with the screw member 53 or 57. However, the beam receiving device may be secured without using a screw member. For example, the beam receiving device may be secured to a side of the beam by a bolt extending through the beam. In addition, a beam receiving device having a different configuration may be used.

All references, including publications, patent applications, and patents, cited herein are hereby incorporated by reference to the same extent as if each reference were individually and specifically indicated to be incorporated by reference and were set forth in its entirety herein. The use of the terms "a" and "an" and "the" and similar referents in the context of describing the invention (especially in the context of the following claims) is to be construed to cover both the singular and the plural, unless otherwise indicated herein or clearly contradicted by context. The terms "comprising,"having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

1: wooden member
2: steel rod (tensile member)
2*a*: end of steel rod
3: groove
4: cutout recess
4*a*: bottom of cutout recess
5: hole
6: screw member
6*a*: spiral blade of screw member
6*b*: shaft portion of screw member
6*c*: through hole of screw member
6*d*: proximal end of screw member
7: nut
8: washer
9: turnbuckle
11: wooden member
11*a*: slit
11*b*: horizontal hole
12: steel rod
13: hollow hole

14: cutout recess
16: screw member
21: wooden member
21*a*: slit
22: steel rod
23: hollow hole
24: cutout recess
26: screw member
27: nut
29: saddle
31: wooden member
31*a*: cutout
32: steel rod
34: cutout recess
36: screw member
37: nut
41 to 49: small cross-section member
51: column
52: beam
53: screw member for beam
54: joint device
55: screw member for column
56: bolt
57: screw member for beam
58: bolt
60: beam receiving device
60*a*: first joint plate portion
60*b*: second joint plate portion
60*c*: pin hole
61: pin
70: beam receiving device
70*a*: first joint plate portion
70*b*: second joint plate portion
71: pin
101, 111, 121, 131: wooden member assembly

What is claimed is:

1. A wooden member assembly, comprising:

a wooden member formed of a wooden material;

two screw members separately disposed from each other in an axial direction of the wooden member, each screw member having a cylindrical shaft portion with a through hole formed therein in an axial direction thereof, each of the screw member having a blade spirally protruding from an outer peripheral surface of the shaft portion, the two screw members axially threaded into the wooden member at two axially separated locations respectively; and a tensile member having two ends, each of the ends inserted through the through hole of each of the two screw members, wherein a hollow hole is formed in the wooden member, the hollow hole extending from one of the two screw members to the other of the two screw members, and wherein the tensile member is disposed in a range from the through hole of the one of the screw members via the hollow hole to the through hole of the other of the screw members, and is fixed between the two screw members, and a tensioning force introduced in the tensile member is kept in the tensile member, in such a way that a reactive force of the tensioning force acts on each of the screw members.

2. The wooden member assembly according to claim 1, wherein a cutout is axially formed in each of ends of the wooden member from a part of each of the end faces thereof to a predetermined depth;

each of the screw members is threaded into the wooden member through each of the cutouts; and each of the cutouts has such a size that allows introduction of a tensioning force into the tensile member and fixation of the tensile member to each of the screw members after each of the end faces of the wooden member is joined in abutting relationship with another member.

3. The wooden member assembly according to claim 2, wherein the wooden member is a laminated wood formed by bonding together a plurality of small cross-section members having a smaller cross-section than the wooden member;

the small cross-section members are bonded together in such a way that a hollow hole extending in the axial direction of the wooden member is formed in the wooden member;

each of the screw members is threaded into the hollow hole from each of the cutouts of the wooden member; and the tensile member is installed in the hollow hole.

4. The wooden member assembly according to claim 3, wherein the through hole of each screw member has an inside diameter which increases toward the end face on the side from which the tensile member inserted into the through hole extends toward the other screw member.

5. The wooden member assembly according to claim 2, wherein the through hole of each screw member has an inside diameter which increases toward the end face on the side from which the tensile member inserted into the through hole extends toward the other screw member.

6. The wooden member assembly according to claim 1, wherein the wooden member is a laminated wood formed by bonding together a plurality of small cross-section members having a smaller cross-section than the wooden member;

the small cross-section members are bonded together in such a way that a hollow hole extending in the axial direction of the wooden member is formed in the wooden member;

each of the screw members is threaded into the hollow hole from each of end faces of the wooden member; and the tensile member is installed in the hollow hole.

7. The wooden member assembly according to claim 6, wherein the through hole of each screw member has an inside diameter which increases toward the end face on the side from which the tensile member inserted into the through hole extends toward the other screw member.

8. The wooden member assembly according to claim 1, wherein the through hole of each screw member has an inside diameter which increases toward the end face on the side from which the tensile member inserted into the through hole extends toward the other screw member.

9. A wooden member assembly, comprising:

a wooden member formed of a wooden material;

two screw members, each screw member having a cylindrical shaft portion with a through hole formed therein in an axial direction thereof, each of the screw members having a blade spirally protruding from an outer peripheral surface of the shaft portion, the two screw members axially threaded into the wooden member at two locations respectively; and a tensile member having two ends, each of the ends inserted through the through hole of each of the two screw members, wherein the tensile member is fixed between the two screw members, and a tensioning force introduced in the tensile member is kept in the tensile member, in such a way that a reactive force of the tensioning force acts on each of the screw members, and wherein, a groove is axially formed in the wooden member except portions in the vicinity of each end thereof;

each of the screw members is threaded into a hole, the hole extending from each of both end faces of the wooden member to the groove, the hole being formed longer than the axial length of each of the screw members; and the tensile member is installed in the groove.

10. The wooden member assembly according to claim 9, wherein, a cutout is axially formed in an opening area of the hole, the opening area being at each of the ends of the wooden member, the cutout being formed from a part of each of the end faces of the wooden member to a predetermined depth;

each of the screw members is threaded into the wooden member through each of the cutouts; and each of the cutouts has such a size that allows introduction of a tensioning force into the tensile member and fixation of the tensile member to each of the screw members after each of the end faces of the wooden member is joined in an abutting relationship with another member.

11. The wooden member assembly according to claim 10, wherein the through hole of each screw member has an inside diameter which increases toward the end face on the side from which the tensile member inserted into the through hole extends toward the other screw member.

12. The wooden member assembly according to claim 9, wherein the through hole of each screw member has an inside diameter which increases toward the end face on the side from which the tensile member inserted into the through hole extends toward the other screw member.

13. A wooden member assembly, comprising:

a wooden member formed of a wooden material;

two screw members separately disposed from each other in an axial direction of the wooden member, each screw member having a cylindrical shaft portion with a through hole formed therein in an axial direction thereof, each of the screw members having a blade spirally protruding from an outer peripheral surface of the shaft portion, the two screw members axially threaded into two hollow holes formed at the wooden member at two axially separated locations respectively; and a tensile member having two ends, each of the ends inserted through the through hole of each of the two screw members, wherein the tensile member is fixed between the two screw members, and a tensioning force introduced in the tensile member is kept in the tensile member, in such a way that a reactive force of the tensioning force acts on each of the screw members, wherein each of the screw members is threaded from each of both end faces of the wooden member into each of the two hollow holes extending from each of the end faces through an upper, lower or side surface of the wooden member, when the wooden member is placed so that an axis of the wooden member is horizontally directed, wherein the tensile member having two ends inserted into the through holes of the screw members is directed from the hollow holes to an outside of the wooden member and extends along the wooden member, and wherein the tensile member is continuously disposed from the through hole of one of the two screw members, via one of the two hollow holes, the outside of the wooden member and another of the two hollow holes, to the through hole of another of the two screw members.

14. The wooden member assembly according to claim 13, wherein a cutout is axially formed in an opening area of the hole, the opening area being at each of the ends of the wooden member, the cutout being formed from a art of each of the end faces of the wooden member to a predetermined depth;

each of the screw members is threaded into the wooden member through each of the cutouts; and each of the cutouts has such a size that allows introduction of a tensioning force into the tensile member and fixation of the tensile member to each of the screw members after each of the end faces of the wooden member is joined in an abutting relationship with another member.

15. The wooden member assembly according to claim 14, wherein the through hole of each screw member has an inside diameter which increases toward the end face on the side from which the tensile member inserted into the through hole extends toward the other screw member.

16. The wooden member assembly according to claim 13, wherein the through hole of each screw member has an inside diameter which increases toward the end face on the side from which the tensile member inserted into the through hole extends toward the other screw member.

* * * * *